US008443944B2

(12) United States Patent
Sonnenmoser et al.

(10) Patent No.: US 8,443,944 B2
(45) Date of Patent: May 21, 2013

(54) MONITORING METHOD FOR AN ELEVATOR INSTALLATION

(75) Inventors: Astrid Sonnenmoser, Ebikon (CH); Kurt Heinz, Regensdorf (CH)

(73) Assignee: Inventio AG, Hergiswil (CH)

( * ) Notice: Subject to any disclaimer, the term of this patent is extended or adjusted under 35 U.S.C. 154(b) by 651 days.

(21) Appl. No.: 12/669,322

(22) PCT Filed: Jul. 4, 2008

(86) PCT No.: PCT/EP2008/058721

§ 371 (c)(1),
(2), (4) Date: Jun. 9, 2010

(87) PCT Pub. No.: WO2009/010410

PCT Pub. Date: Jan. 22, 2009

(65) Prior Publication Data

US 2012/0273307 A1 Nov. 1, 2012

(30) Foreign Application Priority Data

Jul. 17, 2007 (EP) ..... 07112651

(51) Int. Cl.
*B66B 1/28* (2006.01)

(52) U.S. Cl.
USPC ..... 187/247; 187/391

(58) Field of Classification Search
USPC ..... 187/247, 248, 277, 288, 313, 316, 187/317, 391–393
See application file for complete search history.

(56) References Cited

U.S. PATENT DOCUMENTS

| | | | | |
|---|---|---|---|---|
| 3,988,594 | A * | 10/1976 | Low et al. | 307/132 R |
| 5,387,769 | A * | 2/1995 | Kupersmith et al. | 187/248 |
| 5,522,480 | A * | 6/1996 | Hofmann | 187/391 |
| 6,173,814 | B1 * | 1/2001 | Herkel et al. | 187/288 |
| 6,267,219 | B1 | 7/2001 | Spannhake et al. | |
| 6,467,585 | B1 * | 10/2002 | Gozzo et al. | 187/391 |
| 7,334,665 | B2 * | 2/2008 | Smith et al. | 187/247 |
| 7,350,624 | B2 * | 4/2008 | Deplazes et al. | 187/393 |
| 7,909,145 | B2 * | 3/2011 | Erny et al. | 187/393 |
| 8,011,481 | B2 * | 9/2011 | Erny et al. | 187/393 |
| 8,230,977 | B2 * | 7/2012 | Thumm et al. | 187/247 |
| 2004/0173410 | A1 * | 9/2004 | Deplazes et al. | 187/247 |
| 2005/0082121 | A1 | 4/2005 | Deplazes | |
| 2012/0103729 | A1 * | 5/2012 | Finschi | 187/247 |

FOREIGN PATENT DOCUMENTS

WO WO 2005/000727 A1 1/2005

* cited by examiner

*Primary Examiner* — Anthony Salata
(74) *Attorney, Agent, or Firm* — Fraser Clemens Martin & Miller LLC; William J. Clemens

(57) ABSTRACT

The monitoring method for an elevator installation includes a control unit and at least one bus junction, which bus junction has a receiver, a transmitter and a safety element. The control unit and the bus junction communicate by way of a bus. The monitoring method has the following steps: a digital default signal is transmitted by the control unit to the receiver; the digital default signal is converted by the receiver into an analog signal; the safety element is acted on by the receiver with the analog signal; if the safety element is closed the analog signal is detected by the transmitter; for a detected analog signal, a digital signal of the control unit is provided by the transmitter; wherein on detection of an analog zero signal a digital signal is transmitted by the transmitter to the control unit.

16 Claims, 2 Drawing Sheets

MONITORING METHOD FOR AN ELEVATOR INSTALLATION

FIELD OF THE INVENTION

The invention relates to a monitoring method for safety circuits of an elevator installation.

BACKGROUND OF THE INVENTION

Conventional elevator installations have safety circuits consisting of safety elements connected in series. These safety elements monitor, for example, the status of shaft or car doors. Such a safety element can be a contact. An open contact shows that, for example, a door is open and a potentially impermissible door state has occurred. If, now, with the contact opened an impermissible open state of the door is identified then the safety circuit is interrupted. This has the consequence that a drive or brakes, which acts or act on the travel of an elevator car, brings the elevator car to a standstill.

A safety system for an elevator installation is known from the PCT patent specification WO2005/000727, which comprises a control unit as well as at least one bus junction and bus. The bus enables communication between the bus junctions and the control unit. The bus junction monitors, for example, the state of shaft and car doors by means of a safety element, which is a component of the bus junction. Moreover, the bus junction consists of a receiver and a transmitter. In that case the receiver is so designed that it reads digital default signals from the control unit, converts these into an analog signal and thus acts on the safety element. The transmitter in turn measures, after the safety element, the analog signal and converts this into a digital signal. The transmitter makes these digital data available to the control unit. These data are either sent by the bus junctions as digital signals to the control unit or demanded by the control unit by means of interrogation.

In order that safe operation of the elevator installation is guaranteed and the current state of the elevator installation known digital data has to be exchanged between the control unit and the bus junction at short time intervals. This means that the control unit has to have high computing capacities in order to be able to evaluate a multiplicity of digital signals and items of information. In addition, the bus is strongly loaded by signals, which are transmitted between the control unit and the bus junctions, and accordingly has high data transmission capacities.

An object of the present invention is thus to provide a monitoring method for an elevator installation with a reduced data exchange between control unit and bus junction and with a control unit having lower computing capacities.

The object is fulfilled by the invention in accordance with the definition of the independent claim.

SUMMARY OF THE INVENTION

The monitoring method for an elevator installation in accordance with the invention has a control unit and at least one bus junction. This bus junction comprises a receiver, a transmitter and a safety element. The control unit and bus junction communicate by way of a bus. The method executes the following steps:

a. a digital default signal is transmitted by the control unit to the receiver;
b. the digital default signal is converted by the receiver into an analog signal;
c. the safety element is acted on by the receiver with the analog signal;

d. if the safety element is closed the analog signal is detected by the transmitter;
e. for a detected analog signal, a digital signal of the control unit is provided by the transmitter; and
f. on detection of an analog zero signal a digital signal is transmitted by the transmitter to the control unit.

The advantage of this monitoring method resides in the small data exchange between control unit and bus junction. Since the bus junction when the safety element is open, thus when, for example, a shaft door or a car door is open, communicates this potentially risky state to the control unit, a constant short-cyclic communication between control unit and bus junction is eliminated. As a consequence, use can be made of control units with lesser computing capacities as well as buses with smaller data transmission capacities, which leads to lower costs.

Advantageously, the digital default signal is transmitted by the control unit to the receiver at time intervals. During this time interval the safety element is acted on by the receiver with an analog signal corresponding with the preceding digital default signal. In normal operation the digital signal provided by the transmitter is interrogated by the control unit at time intervals. These time intervals are preferably selected to be in the order of magnitude of 100 seconds.

The advantage of these relatively long default and interrogation time intervals is a further relief of the bus between the control unit and the bus junctions function and a further reduction of the signals and data to be processed by the control unit.

Advantageously, on detection of an analog zero signal a digital signal is spontaneously transmitted by the transmitter to the control unit. This is the case, for example, when with the safety element open an analog zero signal is detected by the transmitter. By virtue of the spontaneous transmission of the digital signal, measures are undertaken by the control unit in order to bring the elevator to a safe operational state.

The advantage of the spontaneous transmission of a digital signal by the transmitter to the control unit is based on the fact that the elevator can be safety operated notwithstanding relatively long default and interrogation intervals.

Advantageously, the monitoring method also includes a test procedure. In this test procedure a bus junction is tested by the control unit at time intervals. This test procedure is performed by the control unit at least once per day. In that case, the bus junction is acted on by the control unit with a digital zero default signal which is converted by the receiver into an analog zero signal. Accordingly, the transmitter measures an analog zero signal. Thus, in the case of correct functioning a corresponding digital signal is spontaneously transmitted by the bus junction to the control unit.

The advantage of this test procedure resides in the simple and reliable checking of the functional capability of a bus junction or of the spontaneous transmission behaviour of the transmitter. In this test procedure an open safety element is simulated and the corresponding spontaneous transmission behaviour of the transmitter provoked. The functional capability of the bus junction for normal operation is tested in every default-interrogation cycle.

DESCRIPTION OF THE DRAWINGS

The invention is clarified and further described in detail in the following by way of several exemplifying embodiments and three figures, in which.

DESCRIPTION OF THE PREFERRED EMBODIMENT

Figure 1:
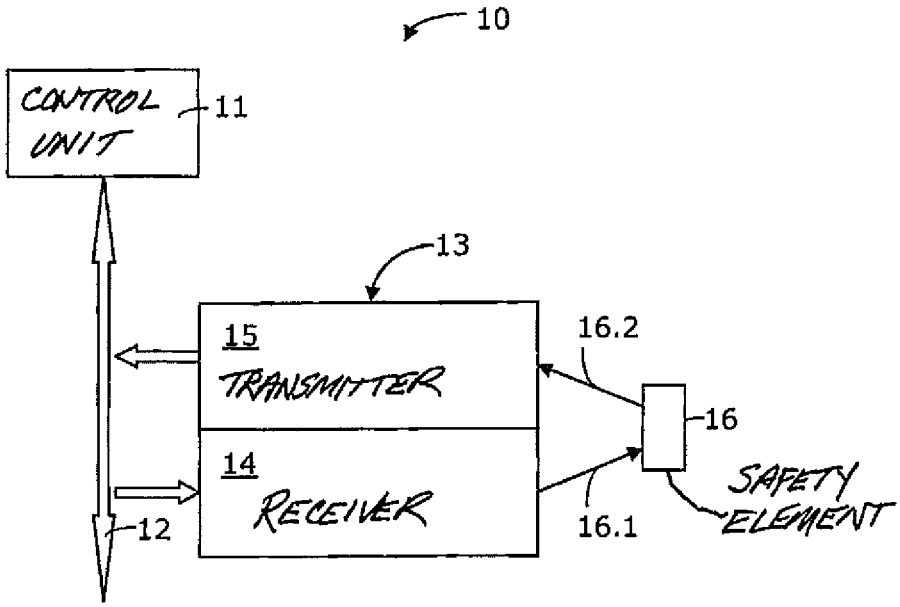
FIG. 1 shows a schematic view of a safety system according to the invention.

The present monitoring method is particularly suitable for elevator installations, as was described in the introduction. FIG. 1 shows a form of embodiment of a safety system 10 according to the invention which is technically adapted to perform the monitoring method. The safety system 10 has a control unit 11 and at least one bus junction 13. The communication between the control unit 11 and the bus junction 13 takes place by way of a bus 12. Data can thus be sent in both directions between the bus junction 13 and the control unit 11 by way of the bus. The bus junction 13 itself consists of a receiver 14, a transmitter 15 and a safety element 16. The receiver 14 and the transmitter 15, respectively, are each so designed that the former receives default signals from the control unit 11 and the latter provides status data as signals of the control unit 11.

The control unit 11, the bus 12 and the at least one bus junction 13 form a bus system. Within this bus system each bus junction 13 has an individual, unique address. The establishing of a communication between the control unit 11 and a bus junction 13 takes place by way of this address.

The control unit 11 sends digital default signals to the receiver 14 by way of the bus 12. The control unit in that case addresses a specific bus junction 13 and communicates the default signal to its receiver 14. The receiver 14 receives this default signal and generates an analog signal which corresponds with the default signal and which acts on the safety element 16. The action of the analog signal is symbolised by the arrow 16.1. The analog signal can be a defined voltage, current strength or frequency.

The safety element 16 shows the state of a safety-relevant element. Thus, the safety element 16 finds use as, for example, a door contact, lock contact, buffer contact, flap contact, sensor, actuator, travel switch or emergency stop switch. The safety element 16 is in that case so designed that a closed safety element 16 represents a safe state and an open safety element 16 represents a potentially risky state of an elevator installation.

When the safety element 16 is closed the transmitter 15 connected to the safety element 16 measures the arriving analog signal. This measuring process is represented by the arrow 16.2. After the measurement, the transmitter 15 converts the measured analog signal into a digital signal. Finally, the transmitter 15 prepares the digital signal for the control unit 11.

In normal operation the control unit 11 transmits a current, voltage or frequency value default signal to a selective bus junction 13 by means of statement of the address of the bus junction 13 and a current, voltage or frequency value in digital form. This default signal is repeated at specific time intervals, i.e. the control unit 11 transmits a new current, voltage or frequency value to the bus junction 13. The new value preferably differs from the preceding value. Within such a time interval the receiver generates, according to the default signal, a specific analog signal. If the safety element is closed the transmitter 15 measures this analog signal and prepares the measured value as a digital signal. At the cyclic rate of the above-mentioned time interval the control unit 11 addresses the transmitter 15 of the bus junction 13 and by way of a reading function obtains the data of the current, voltage or frequency value prepared as a digital signal.

The time intervals between such default-interrogation cycles are in principle freely settable and primarily depend on the reliability of the bus junction components. For preference these time intervals last for several seconds. In the case of high reliability, time intervals of 100 seconds or longer can also be set.

The control unit 11 performs this method with all bus junctions 13 of the series and checks the resonance thereof, i.e. the default signals and the digital signals provided by the respective transmitters 15 are compared by the control unit 11. If the default signals correspond with the prepared digital signals, the control unit recognises that the receiver 14 and the transmitter 15 function correctly.

A fault current, a fault voltage or a fault frequency is present if the transmitter 15 measures a current of 0 mA, a voltage of 0 mV or a frequency of 0 Hz. This corresponds with the state of an open safety element, thus, for example, an open car or shaft door. If now, for example, a fault current is measured by the transmitter 15, the transmitter 15 spontaneously sends the transmitted value to the control unit 11. Thanks to the unique address of the bus junction 13 the control unit 11 is capable of precisely localizing the fault. The control unit 11 optionally resorts to measures in order to eliminate the fault or to transfer the elevator to a safe operating mode. These operating modes comprise, inter alia, maintenance of a residual capability of the elevator in a safe travel range of the elevator car, the evacuation of trapped passengers, an emergency stop or, ultimately, the warning of maintenance and service personnel to free trapped passengers and/or eliminate a fault not able to be removed by the control unit.

The safe operation of a bus junction 13 primarily depends on the functional capability of the receiver 14 and transmitter 15. Since the receiver 14 and the transmitter 15 are already tested in normal operation in each default-interrogation cycle with respect to the functional capability thereof, the bus junction 13 needs a separate test in order to check the spontaneous transmission behaviour of the transmitter 15 on occurrence of a fault.

In this separate test an open safety element 16 is simulated. The control unit 11 simulates the open safety element 16 in that a default signal of 0 mA, 0 mV or 0 Hz is passed to a specific bus junction 13. A zero default test is thus concerned in that case. In the case of fault-free functioning of the bus junction 13 the bus junction 13 or the transmitter 15 thereof must spontaneously report to the control unit 11. This test guarantees that every opening of a safety element 16 leads to a spontaneous transmission of a digital signal of the bus junction 13 to the control unit 11.

This test is carried out repeatedly in time for each bus junction 13. Since during this test the control unit 11 cannot recognize any real data about the state of the safety element 16 of a tested bus junction 13 the test time is kept as short as possible and the test is carried out only as often as necessary. The test time is in that case largely dependent on the speed of data transmission by way of the bus 12 and usually amounts to 50 to 100 milliseconds. The frequency of the zero default test is oriented primarily to the reliability of the transmitter 15 used. The more reliable the transmitter 15, the less frequently does this have to be tested so that a safe operation of the elevator can be guaranteed.

As a rule the zero default test is carried out at least once per day. However, this test can also be repeated in the order of magnitude of minutes or hours.

Figure 2:
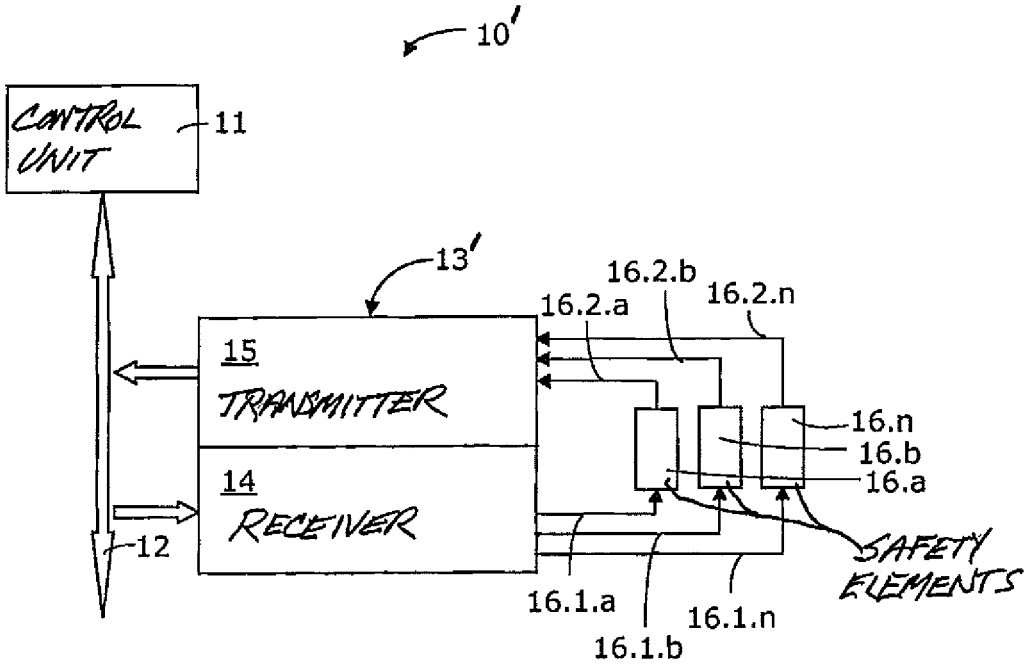
FIG. 2 shows a schematic view of a second form of embodiment of a safety system according to the invention.

FIG. 2 shows a second form of embodiment of the safety system 10' according to the invention. By contrast to the safety system 10 of FIG. 1 the safety element 16 is of redundant design. Each bus junction 13' thus has at least two safety elements 16.*a*, 16.*b*, 16.*n*. In FIG. 2, for example, three safety elements 16.*a*, 16.*b*, 16.*n* monitor the state of a safety-relevant element of the elevator. In that case each safety element 16.*a*, 16.*b*, 16.*n* preferably lies at a separate output 16.1.*a*, 16.1.*b*, 16.1.*n* of the receiver 14, which acts on the safety elements 16.*a*, 16.*b*, 16.*n* in accordance with the default signal of the control unit 11 by an analog signal. These signals can have the same or different values. In the case of closed contacts 16.*a*, 16.*b*, 16.*n* the transmitter 15 measures the arriving analog signal at each of separate inputs 16.2.*a*, 16.2.*b*, 16.2.*n*. In normal operation the transmitter 15 makes available the measured analog values as digital signals of the control unit 11, which regularly interrogates the bus junctions 13'. If an analog zero signal is measured at an input 16.2.*a*, 16.2.*b*, 16.2.*n*, the transmitter 15 spontaneously reports this to the control unit 11.

The advantage of this form of embodiment is that it is also possible to make use of more advantageous, but not secure, safety elements 16.*a*, 16.*b*, 16.*n*. A safe status monitoring of the elevator is guaranteed by the redundant design thereof.

Figure 3:
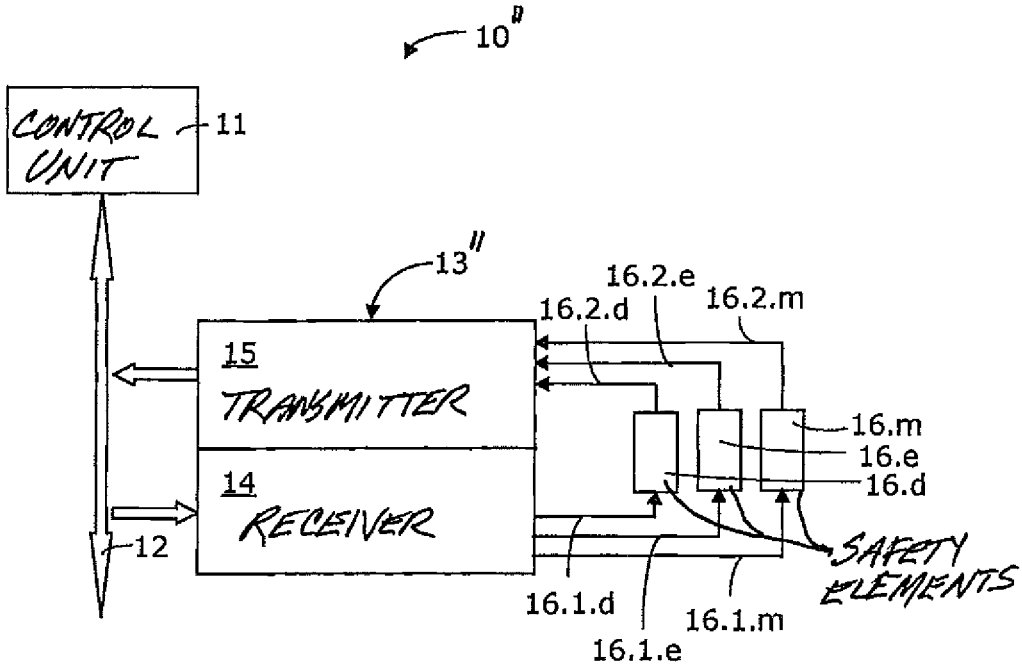
FIG. 3 shows a schematic view of a third form of embodiment of a safety system according to the invention.

A third form of embodiment of the safety system 10" according to the invention is shown in FIG. 3. In this form of embodiment the states of several safety-relevant elements of the elevator are detected by means of a bus junction 13". Each state of a safety-relevant element is detected by a safety element 16.*d*, 16.*e*, 16.*m*. The combining of the safety elements 16.*d*, 16.*e*, 16.*m* in a bus junction 13" is preferably realized when the safety-relevant elements to be monitored lie physically close to one another, such as, for example, upper adjacent shaft doors or the car door and an alarm button mounted on the elevator car.

The control unit 11 preferably sends, for each safety element 16.*d*, 16.*e*, 16.*m*, different default signals to the receiver. The receiver 14 converts the default signals into a corresponding analog signal and acts on the respective safety element 16.*d*, 16.*e*, 16.*m* by way of a separate output 16.1.*d*, 16.1.*e*, 16.1.*m*. If the safety elements 16.*d*, 16.*e*, 16.*m* are closed the transmitter 15 measures, for each safety element, the arriving analog signal at a separate input 16.2.*d*, 16.2.*e*, 16.2.*m*. Here, too, in normal operation of the transmitter the measured analog values are provided as digital signals of the control unit 11, which regularly interrogates the bus junctions 13". The transmitter 15 preferably also provides information about at which input 16.2.*d*, 16.2.*e*, 16.2.*m* the analog signal was measured. If an analog zero signal is measured at an input 16.2.*d*, 16.2.*e*, 16.2.*m*, the fault source can be uniquely localized thanks to the separate inputs 16.2.*d*, 16.2.*e*, 16.2.*m*.

The advantage of this form of embodiment is the smaller number of bus junctions 13" required and the costs saving thereby achievable.

The examples illustrated in FIGS. 2 and 3 can also be combined. Thus, bus junctions 13 can be designed in such a manner that the state of several safety-relevant elements of the elevator is detected by a respective redundant safety element 16.

The bus junctions 13', 13" described in FIGS. 2 and 3 are tested not only in normal operation in each default-interrogation cycle for the resonance thereof, but also by means of a zero default signal. These tests are preferably carried out separately for each safety element 16.*a*, 16.*b*, 16.*n*; 16.*b*, 16.*e*, 16.*m*. The functional capability of all outputs of the receiver 14 and all inputs of the transmitter 15 are thus individually tested together.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for monitoring an elevator installation with a control unit and at least one bus junction, which bus junction includes a receiver, a transmitter and a safety element, the control unit and the bus junction communicating through a bus, comprising the steps of:

a. transmitting a digital default signal from the control unit to the receiver;

b. converting the digital default signal into an analog signal in the receiver;

c. acting on the safety element by the receiver with the analog signal; and d. if the safety element is closed, the analog signal is detected by the transmitter;

e. in response to the detected analog signal, a digital signal is provided by the transmitter to the control unit representing a safe state of the safety element.

2. The method according to claim 1 wherein the digital default signal is transmitted by the control unit to the receiver at predetermined time intervals and that during each of the time intervals the safety element is acted on by the receiver with the analog signal corresponding with the preceding transmitted digital default signal.

3. The method according to claim 2 wherein the time intervals are at least 100 seconds long.

4. The method according to claim 1 wherein during operation the digital signal provided by the transmitter is interrogated by the control unit at predetermined time intervals.

5. The method according to claim 4 wherein the time intervals are at least 100 seconds long.

6. The method according to claim 1 wherein on detection of an analog zero signal from the safety element the digital signal is spontaneously transmitted by the transmitter to the control unit.

7. The method according to claim 6 wherein the control unit responds to the spontaneous transmission of the digital signal by bringing the elevator installation into a safe operating state.

8. The method according to claim 1 wherein when the safety element is in open state an analog zero signal is detected by the transmitter as the analog signal.

9. The method according to claim 1 wherein the bus junction is tested by the control unit at predetermined time intervals.

10. The method according to claim 9 wherein the time intervals are at least 100 long.

11. The method according to claim 9 wherein the bus junction is acted on by the control unit with the digital default signal and the bus junction is interrogated by the control unit.

12. The method according to claim 9 wherein the bus junction is acted on by the control unit with a digital zero default signal, which digital zero default signal is converted by the receiver into an analog zero signal, and the digital signal is spontaneously transmitted by the bus junction to the control unit.

13. The method according to claim 9 where in the bus junction is tested by the control unit at least daily.

14. The method according to claim 9 wherein the bus junction is tested by the control unit hourly.

15. The method according to claim 9 wherein the bus junction is tested by the control unit by the minute.

16. A safety system for performance of a monitoring method in an elevator installation comprising:

a control unit for transmitting a digital default signal;

at least one bus junction including a receiver, a transmitter and a safety element; and a bus connecting said control unit and said bus junction for communication whereby said control unit transmits said digital default signal through said bus to said receiver, said receiver converts said digital default signal into an analog signal and acts on said safety element with said analog signal, if said safety element is closed, said analog signal is detected by said transmitter, and in response to said detected analog signal, a digital signal is provided by said transmitter through said bus to said control unit representing a safe state of said safety element.

* * * * *